United States Patent [19]

Shirai et al.

[11] Patent Number: 4,858,572

[45] Date of Patent: Aug. 22, 1989

[54] DEVICE FOR ADJUSTING AN ANGULAR PHASE DIFFERENCE BETWEEN TWO ELEMENTS

[75] Inventors: Eiji Shirai, Okazaki; Yoshio Okabe, Chiryu; Yukimori Kobayashi, Gamagohri, all of Japan

[73] Assignee: Aisin Seiki Kabushiki Kaisha, Kariya, Japan

[21] Appl. No.: 252,054

[22] Filed: Sep. 30, 1988

[30] Foreign Application Priority Data

Sep. 30, 1987 [JP] Japan ..... 62-246880

[51] Int. Cl.[4] ..... F01L 1/34; F01L 9/02

[52] U.S. Cl. ..... 123/90.12; 123/90.15; 123/90.31

[58] Field of Search ..... 123/90.12, 90.13, 90.15, 123/90.16, 90.27, 90.31, 90.17

[56] References Cited

U.S. PATENT DOCUMENTS

| | | | |
|---|---|---|---|
| 3,827,413 | 8/1974 | Meacham | 123/90.15 |
| 4,421,074 | 12/1983 | Garcea et al. | 123/90.15 |
| 4,535,731 | 8/1985 | Banfi | 123/90.17 |
| 4,601,266 | 7/1986 | Oldfield et al. | 123/90.15 |
| 4,762,097 | 8/1988 | Baker | 123/90.31 |
| 4,787,345 | 11/1988 | Thoma | 123/90.17 |

FOREIGN PATENT DOCUMENTS

| | | | |
|---|---|---|---|
| 3247916 | 6/1984 | Fed. Rep. of Germany | 123/90.31 |
| 0268810 | 11/1986 | Japan | 123/90.15 |

*Primary Examiner*—Charles J. Myhre
*Assistant Examiner*—Weilun Lo
*Attorney, Agent, or Firm*—Oblon, Spivak, McClelland, Maier, & Neustadt

[57] ABSTRACT

For adjusting an angular phase difference between an engine crank shaft and an engine cam shaft, fluid under pressure is supplied into one or more chambers defined therebetween. The adjusted condition is maintained or held by mechanical engagement between both shafts.

9 Claims, 3 Drawing Sheets

DEVICE FOR ADJUSTING AN ANGULAR PHASE DIFFERENCE BETWEEN TWO ELEMENTS

BACKGROUND OF THE INVENTION

1. Field of the Invention

The present invention relates to a device for adjusting an angular phase difference and in particular to a device for adjusting an angular phase difference between an engine crank shaft and an engine cam shaft.

2. Description of the Prior Art

A conventional device of this kind is disclosed in U.S. Pat. No. 2,861,557, for example. In the conventional device, a drive member to be driven by an engine crank shaft is rotatably mounted on an engine cam shaft having a cam member which acts on a tappet. A hub is also fixedly mounted on the cam shaft so as to be enclosed by the drive member. The drive member is provided with a pair of equi-spaced vanes, each of which is extended inwardly in the radial direction so as to be brought into sliding engagement with an outer surface of the hub. The hub is also provided with a pair of equi-spaced vanes, each of which is extended outwardly in the radial direction so as to be brought into engagement with an inner surface of the drive member. Thus, between each of the vanes of the drive member and each of the vanes of the hub there is defined an oil chamber to which fluid under pressure is supplied. In such a construction, when fluid under pressure is supplied into each oil chamber, the volume thereof is increased, thereby increasing an angular phase difference between the drive member and the hub. Thus, the cam shaft is advanced through an angle relative to the crank shaft.

However, since fluid in each chamber serves for transmitting the rotational torque from the crank shaft to the cam shaft in the above-mentioned construction, the pressure of the fluid has to overcome the rotational torque from the crank shaft in order to retain or hold the advanced condition of the cam shaft relative to the crank shaft. This means that a high powered oil pump as to be used. In other words, fluid which already circulates in an engine system for the lubrication thereof cannot be utilized.

Further, in the conventional device, before advance of the cam shaft relative to the drive member, a ball holding the connection therebetween is moved outwardly in the radial direction as a result of centrifugal effect on the ball. This means that the cam shaft may not be advanced relative to the drive member while the engine is operated at a low speed.

SUMMARY OF THE INVENTION

It is, therefore, a primary object of the present invention to provide a device for adjusting an angular phase difference without the aforementioned drawbacks.

Another object of the present invention is to provide a device for adjusting an angular phase difference, which may be actuated by fluid at a relatively low pessure.

Still another object of the present invention is to provide a device for adjusting an angular phase difference, which may be operated regardless of an engine speed.

In order to achieve the above objects, and in accordance with the purposes of the present invention, a device is provided for adjusting an angular phase difference between a cam shaft rotatably supported on an engine and having a cam member which acts on a tappet, and a drive member rotatably mounted on the cam shaft and driven by the rotational torque from a crank shaft. The device includes a hub fixedly mounted on the cam shaft and enclosed by the drive member to define a chamber between the drive member and the hub, the chamber having a pair of circumferentially opposed walls. A vane is fixedly mounted to the hub and extends outwardly therefrom in the radial direction and into the chamber so as to divide the chamber into a first section and a second section which are fluid tightly separated from each other. A fluid supplying means supplies fluid under pressure to a selected one of the first section and the second section via respective first and second passage means, together with means for preventing counter flow of the fluid under pressure from the first and second sections. A first connecting means mechanically connects the hub and the drive member when the vane is in abutment with one of the circumferentially opposed walls of the chamber and releases the mechanical connection between the hub and the drive member when the pressure of the fluid in the first passage means exceeds a set value. Second connecting means mechanically connect the hub and the drive member when the vane is brought into abutment with the other of the circumferentially opposed walls of the chamber after a rotary movement of the hub through a set angle, and releases this mechanical connection when the fluid pressure in the second passage means exceeds a set value.

BRIEF DESCRIPTION OF THE DRAWINGS

The above and other objects, features and advantages of the present invention will become more apparent and more readily appreciated from the following detailed description of preferred exemplary embodiments of the present invention, taken in connection with the accompanying drawings, in which.

DETAILED DESCRIPTION OF THE PREFERRED EMBODIMENTS

Figure 1:
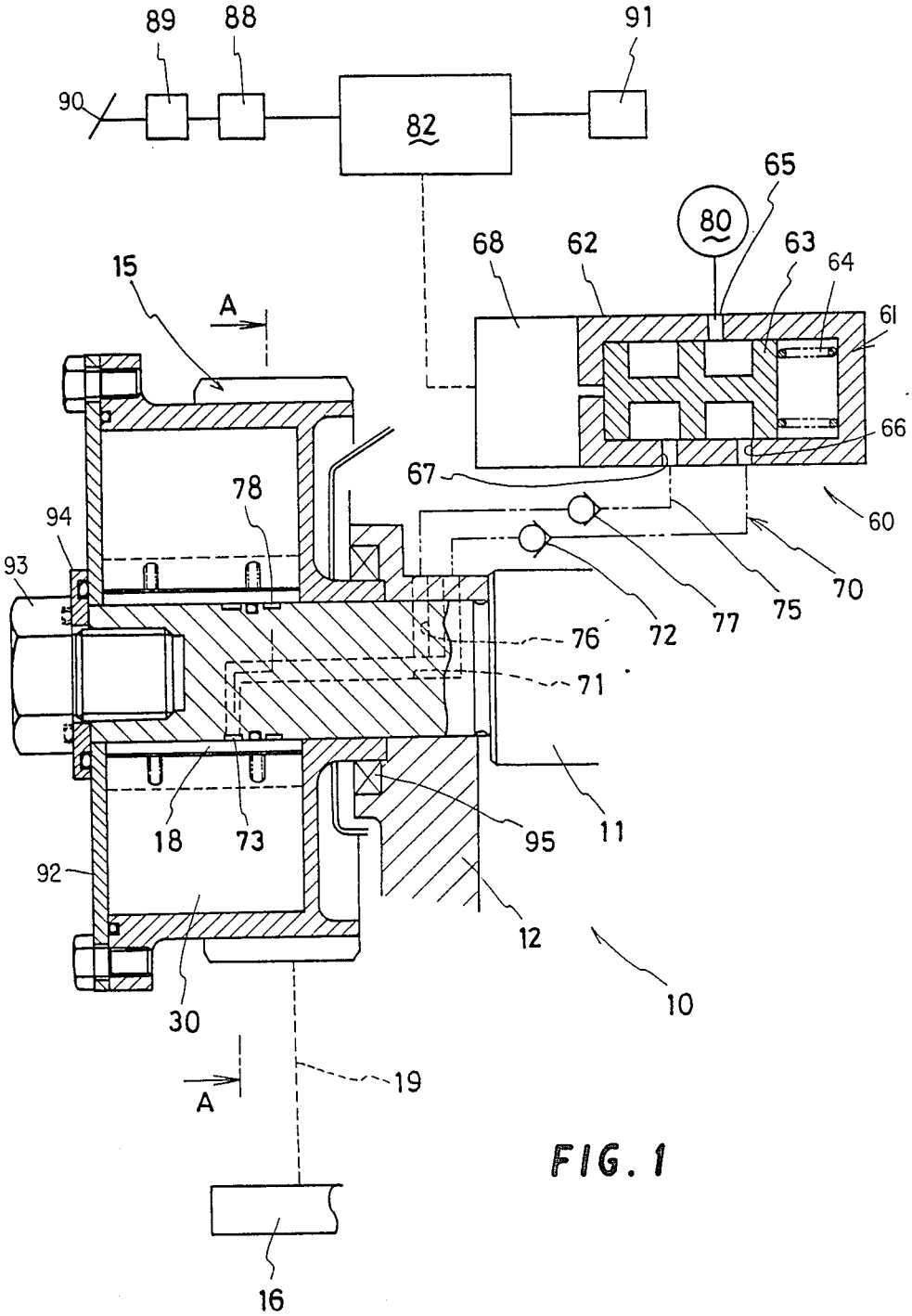
FIG. 1 is a veiw, partially in section, showing the entire device for adjusting an angular phase difference according to the invention.
Figure 2:
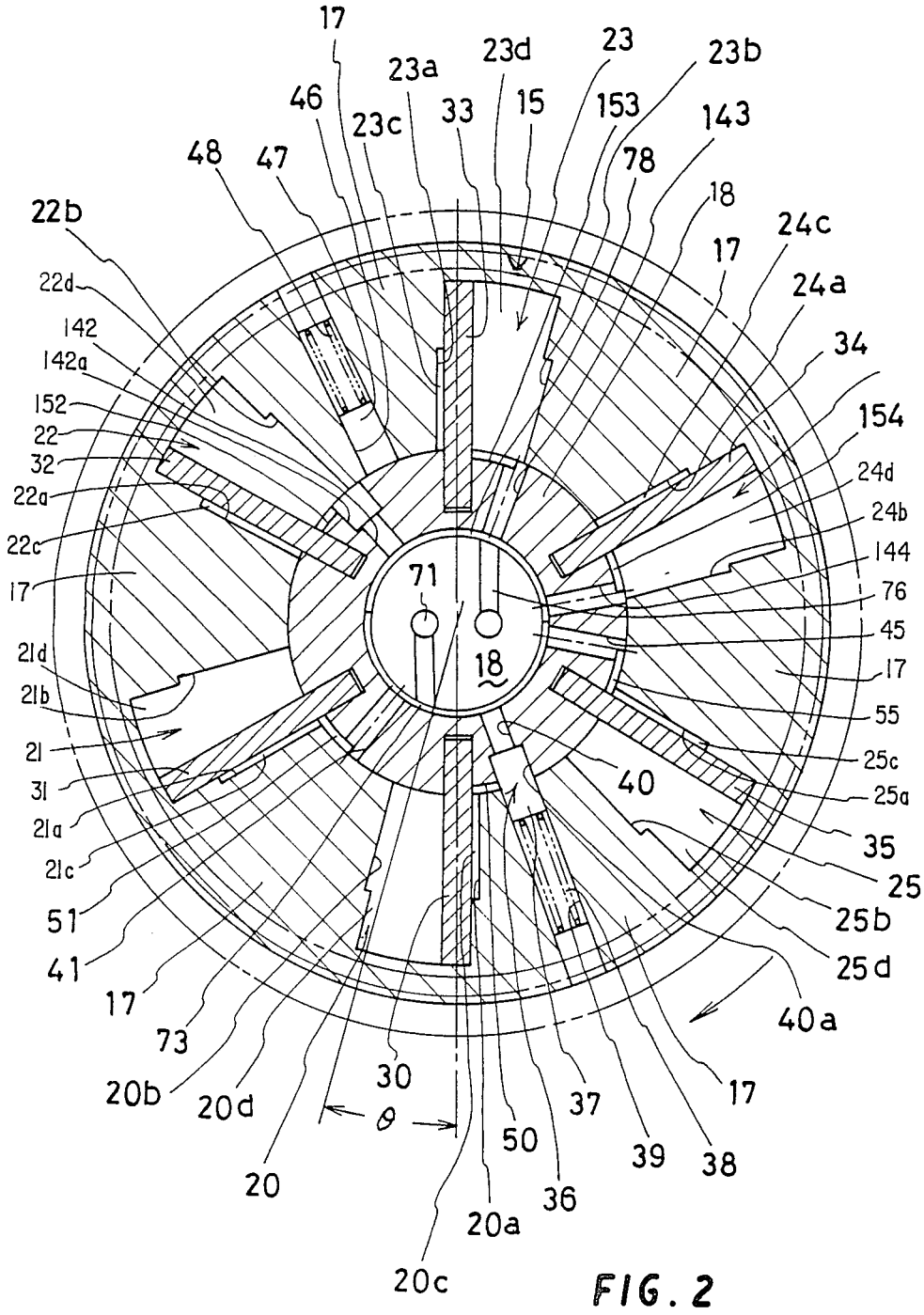
FIG. 2 is a cross-sectional view taken along line A—A of FIG. 1.
Figure 3:
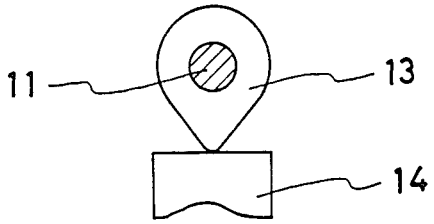
FIG. 3 is a view for showing the relationship between a cam meber on a cam shaft and a tappet.

Referring now to FIGS. 1 through 3, a device 10 includes a cam shaft 11 which is rotatably supported on an engine 12. At a portion of the cam shaft 11, there is fixedly mounted a cam 13 (FIG. 3) which acts on an upper surface of a tappet 14 as is well-known. On a left end portion of the cam shaft 11, there is rotatably mounted a drive member 15 having teeth 15*a* to which rotational torque is transmitted via a belt 19 from a crank shaft 16 which is rotated by the engine 12.

The drive member 15 is provided at an inner side thereof with a plurality of circumferentially equi-space projections 17, each of which extends inwardly in the radial direction. An inner end portion of each projection 17 is in sliding engagement with an outer surface of a hub 18 which is fixedly mounted on the cam shaft 11 and is enclosed by the drive member 15. Between the drive member 15 and the hub 18, there are defined six chambers 20, 21, 22, 23, 24 and 25 which are arranged in an equi-spaced manner in the circumferential direction. Each chamber 20, 21, 22, 23, 24 and 25 has a pair of circumferentially opposed, radially extending walls 20*a* and 20*b*, 21*a* and 21*b*, 22*a* and 22*b*, 23*a* and 23*b*, 24*a* and 24*b*, 25*a* and 25*b*.

On the hub 18, six vanes 30, 31, 32, 33, 34 and 35, are fixedly mounted in an equi-spaced manner in the circumferential direction. The vane 30, which projects outwardly from the hub 19 in the radial direction, is extended into the corresponding chamber 20 so that the chamber 20 is divided into a first section 20*c* and a second section 20*d*, both of which are fluid-tightly separated from each other. The chambers 21, 22, 23, 24 and 25 are so divided in a manner similar to the chamber 20.

In the condition shown in FIG. 2, the vanes 30, 31, 32, 33, 34 and 35 are in abutment with the walls 20*a*, 21*a*, 22*a*, 23*a*, 24*a* and 25*a*, respectively. For maintaining such a condition, a first connecting means 36 is employed. The connecting means is in the form of a pin 37 extending into a radial bore 39 of one of the projections, the pin 37 being urged inwardly by a spring 38 accommodated in the bore 39. An upper end of the pin 37 is fitted into a large-radius portion 40a of a radial hole 40 in the hub 18. The hub 18 is thus prevented from rotary movement relative to the drive member 15.

Fluid under pressure is supplied to the first sections 20*c*, 21*c*, 22*c*, 23*c*, 24*c* and 25*c* or to the second sections 20*d*, 21*d*, 22*d*, 23*d*, 24*d* and 25*d* from a fluid supply means 60 which will be described below. In order to supply fluid to the first section 20*c*, fluid under pressure passes through the radial hole 40 while pushing the pin 37 fully into the bore 39 against the load of the spring 38, and enters a circumferential groove 50 in the hub 18. Due to continuous supply of fluid in each first section, the vanes and the hub 18 are brought into clockwise unitary rotation relative to the drive member 15. This rotation of the hub 18 is completed when a pin 47 of a second connecting means 46 in another projection 17 is urged inwardly in the radial direction by spring 48 upon being brought into alignment with a large-radius portion 142*a* of the hole 142.

The fluid supplying means 60 is provided for supplying fluid under pressure to either respective first sections 20*c*, 21*c*, 22*c*, 23*c*, 24*c* and 25*c* via a first passage means 70 or respective second sections 20*d*, 21*d*, 22*d*, 23*d*, 24*d* and 25*d* via a second passage means 75. The fluid supplying means 60 includes an oil pump 80 from which fluid under pressure is delivered. Oil from pump 80 may also be utilized for the lubrication of the engine system. A switching valve apparatus 61 has a casing 62 in which a sliding member 63 is mounted. Normally, the sliding member 63 is urged in the leftward direction by a spring 64 so as to establish the fluid communication between an inlet port 65 to which fluid is supplied from the pump 80 and a first outlet port 66.

On the other hand, upon actuation of a solenoid 68 due to receipt of an order or a command from a controller 82 in the form of a microcomputer, the sliding member 63 is moved in the rightward direction against the load of the spring 64.

In the cam shaft 11, there are formed a first path 71 and a second path 76 which respectively belong to the first passage means 70 and the second passage means 75. Between the first outlet port 66 (the second outlet port 67) and the first path 71 (the second path 76) there is interposed a first check-valve 72 (a second check-valve 77) for preventing counter flow of fluid to the oil pump 80. The first path 71 (the second path 76) is in fluid communication with a first annular passage 73 (a second annular passage 78).

The first annular passage 73 is in fluid communication with the first sections 20*c*, 21*c*, 22*c*, 23*c*, 24*c* and 24*c* via, respectively, a set of the hole 40 and the groove 50, a set of a hole 41 and a groove 51, sets of holes and grooves (not shown) similarly communicated to first sections 22*c*, 23*c*, 24*c*, and a set of a hole 45 and a groove 55. The second sections 20*d*, 21*d*, 22*d*, 23*d*, 24*d* and 25*d* are in fluid communication with the second annular passage 78 via, respectively, a set of the hole 142 and a groove 152, a set of a hole 143 and a groove 153, a set of a hole 144 and a groove 154 and sets of holes and grooves (not shown) similarly communicated to second sections 20*d*, 21*d* and 25*d*.

The controller 82 is electrically connected to a first sensor 88 which detects an amount of opening of a throttle valve 89 operatively connected to an accelerator pedal 90, and a second sensor 91 which detects the speed or the rotational number of the engine 12. In response to signals from both sensors 88 and 91, the controller 82 controls the valve apparatus 61. In this embodiment, the solenoid 68 is actuated when the amount of the opening of the throttle valve 89 is large during the low speed operation of the engine 12 so as not to generate an angular phase difference between the cam shaft 11 and the crank shaft 16. For easy assembly of the device 10, a left wall 92 of the drive member 15 is detachably and movably held to the cam shaft 11 by a bolt 93 and a spacer 94. Further, for assuring the smooth rotation of the drive member 15 on the cam shaft 11, a bearing 95 is employed.

In operation, when the engine 12 is started, the pressure of fluid delivered from the oil pump 80 is increased up to a set value. Fluid under the resulting pressure is supplied to the valve apparatus 61. If the solenoid 68 is not actuated, fluid is supplied to the holes 40, 41, 45 (and the non-illustrated holes for the first sections 22*c*, 23*c* and 24*c*), via the first check valve 72. Fluid under pressure supplied into the hole 40 urges the pin 36 fully into the bore 39, thereby releasing the connection between the hub 18 and the drive member 15. Then, fluid under pressure is supplied into the first sections 20*c*, 21*c*, 22*c*, 23*c*, 24*c* and 25*c* via the grooves 50, 51, 55 (and the nonillustrated grooves for the first sections 22*c*, 23*c* and 24*c*), thereby rotating the vanes 30, 31, 32, 33, 34 and 35 by the angle $\theta$ in the clockwise direction, together with the hub 18. Upon fitting of the pin 47 into the large-radius portion 142*a* of the hole 142, such rotation is terminated. Thus, the cam shaft 11 which is fixedly connected to the hub 18 is advanced through an angle relative to the crank shaft 16, which is operatively connected to the drive member 15. Due to an irregular profile of the cam member 13 as shown in FIG. 3, the torque applied to the cam shaft 11 is increased or decreased periodically. In the former case, though the pressure in the first passage means 70 is increased, the resulting pressure is prevented from counter-flowing to the oil pump 80 by the check valve 72.

On the other hand, for returning the cam shaft 11 from the advanced condition to the original condition, respective vanes 30, 31, 32, 33, 34 and 35 are rotated in the counter-clockwise direction by supplying fluid under pressure to the second sections 20*d*, 21*d*, 22*d*, 23*d*, 24*d* and 25*d* via second passage means 75. Since the rotational direction of each vane is the same as the rotational direction of the drive member, each vane is easily returned to its original position as shown in FIG.

2 by the fluid pressure. During the returning rotary movement of each vane, fluid in each first section is drained through a non-illustrated clearance between the hub 18 and the cam shaft 11.

Figure 4:
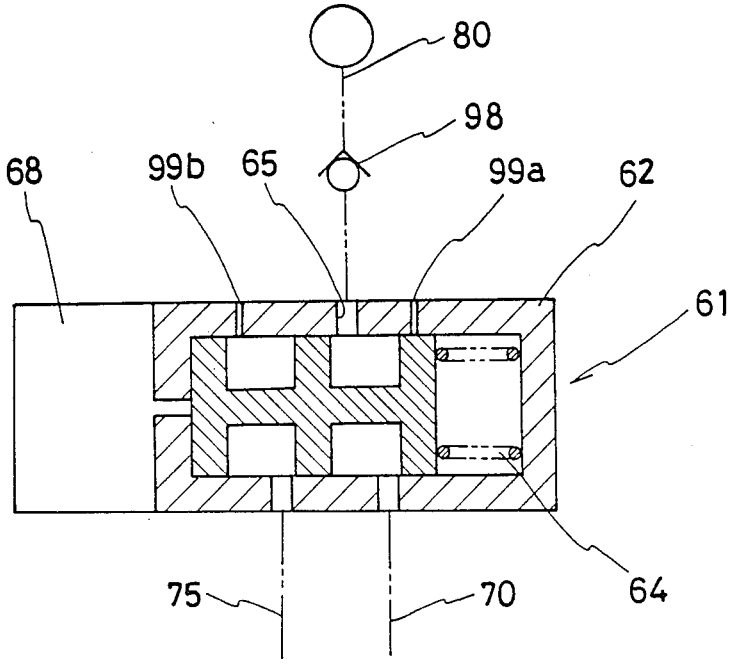
FIG. 4 is a cross-sectional view of another construction of a valve of the invention.

As shown in FIG. 4, instead of the pair of check-valves 72 and 77, a single check-valve 98 which is disposed between the valve apparatus 61 and the oil pump 80 is possible. According to this construction, fluid is drained from a port 99*a* or 99*b* to the lubricating circuit.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A device for adjusting an angular phase difference between a cam shaft rotatably supported on an engine and having a cam member which acts on a tappet, and a drive member rotatably mounted on said cam shaft and driven by the rotational torque from a crank shaft, comprising:

a hub fixedly mounted on said cam shaft and enclosed by said drive member;

a chamber defined between said drive member and said hub and having a pair of circumferentially opposed walls;

a vane fixedly mounted to said hub and extended outwardly therefrom in the radial direction into said chamber so as to divide said chamber into a first section and a second section which are fluid-tightly separated from each other;

a fluid supplying means for supplying fluid under pressure to a selected one of said first section and said second section via respective first and second passage means;

means for preventing counter flow of said fluid under pressure from said first and second sections;

a first connecting means for mechanically connecting said hub and said drive member when said vane is in abutment with one of said circumferentially opposed walls of said chamber and for releasing the mechanical connection between said hub and said drive member when the pressure of fluid in said first passage means exceeds a set value; and a second connecting means for mechanically connecting said hub and said drive member when said vane is brought into abutment with an other of said circumferentially opposed walls of said chamber after a rotary movement of said hub through a set angle and for releasing the mechanical connection between said hub and said drive member when the fluid pressure in said second passage means exceeds a set value.

2. A device in accordance with claim 1 further including at least one additional chamber and one vane in each said additional chamber, wherein all of said chambers and said vanes are arranged in an equi-spaced manner in the circumferential direction.

3. A device in accordance with claim 1 wherein said fluid supplying means includes an oil pump from which fluid under pressure is delivered, a switching valve apparatus connected to said oil pump and alternately connected to said first passage means and said second passage means, and one-way valve means preventing counter flow of fluid to said oil pump and comprising said means for preventing counter flow.

4. A device in accordance with claim 3 wherein said one-way valve means comprises a first check-valve and a second check valve disposed in said first passage means and said second passage means respectively.

5. A device in accordance with claim 3 wherein said one-way valve means is a single check-valve disposed between said switching valve and said oil pump.

6. A device in accordance with claim 3 wherein said switching valve is an electrically operated valve.

7. A device in accordance with claim 6 including microcomputer means for controlling said electrically operated valve.

8. A device in accordance with claim 7 wherein said microcomputer means comprises means for controlling said electrically operated valve based on a set of parameter signals.

9. A device in accordance with claim 8 wherein said parameter signals are an engine speed and an amount of opening of a throttle valve.

* * * * *